US009933751B2

(12) United States Patent
Hwang

(10) Patent No.: US 9,933,751 B2
(45) Date of Patent: Apr. 3, 2018

(54) CARTRIDGE SUPPORT MEMBER AND IMAGE FORMING APPARATUS HAVING THE SAME

(71) Applicant: S-PRINTING SOLUTION CO., LTD., Suwon-si, Gyeonggi-do (KR)

(72) Inventor: Ho-hyun Hwang, Suwon-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/648,926

(22) Filed: Jul. 13, 2017

(65) Prior Publication Data

US 2018/0052423 A1 Feb. 22, 2018

(30) Foreign Application Priority Data

Aug. 16, 2016 (KR) ..... 10-2016-0103731

(51) Int. Cl.
*G03G 21/18* (2006.01)

(52) U.S. Cl.
CPC ..... *G03G 21/1867* (2013.01)

(58) Field of Classification Search
CPC ..... G03G 21/1867
See application file for complete search history.

(56) References Cited

U.S. PATENT DOCUMENTS

| | | | | |
|---|---|---|---|---|
| 9,195,212 | B2 | 11/2015 | Maeda et al. | |
| 2008/0279579 | A1* | 11/2008 | Kuruma | G03G 21/1867 399/90 |
| 2012/0177403 | A1* | 7/2012 | Murayama | G03G 21/1867 399/111 |
| 2014/0147158 | A1* | 5/2014 | Fujinaka | G03G 21/1623 399/90 |

FOREIGN PATENT DOCUMENTS

| | | |
|---|---|---|
| JP | 2004-69943 | 3/2004 |
| JP | 2012-234190 | 11/2012 |
| JP | 2013-246372 | 12/2013 |
| JP | 5518146 | 6/2014 |

* cited by examiner

*Primary Examiner* — Sandra Brase
(74) *Attorney, Agent, or Firm* — Staas & Halsey LLP

(57) ABSTRACT

An image forming apparatus includes a main body, a cartridge support member configured to have a process cartridge provided with first electrical contact points attachable thereto, and a holder configured to have second electrical contact points which are electrically contactable to the first electrical contact points. When the cartridge support member is moved from a first position to a second position in the main body, the second electrical contact points are electrically connected to the first electrical contact points while the cartridge support member is at the first position, while the cartridge support member moves between the first position and the second position, and while the cartridge support member is at the second position. The holder electrically disconnects the second electrical contact points from the first electrical contact points when the cartridge support member is moved to a third position outside the main body.

20 Claims, 15 Drawing Sheets

CARTRIDGE SUPPORT MEMBER AND IMAGE FORMING APPARATUS HAVING THE SAME

CROSS-REFERENCE TO RELATED APPLICATIONS

This application claims the priority benefit of Korean Patent Application No. 10-2016-0103731, filed on Aug. 16, 2016, in the Korean Intellectual Property Office, the disclosure of which is incorporated herein by reference in its entirety.

BACKGROUND

1. Field

Apparatuses disclosed herein relate to a cartridge support member and an image forming apparatus having the same, and more particularly, to a cartridge support member for maintaining an electrical contact between a main body and a cartridge and an image forming apparatus having the same.

2. Description of the Related Art

An image forming apparatus using an electrophotography type prints an image on a recording medium by supplying a toner to an electrostatic latent image formed on a photoreceptor to form a visible toner image on the photoreceptor, transferring the toner image to the recording medium, and then fixing the transferred toner image on the recording medium.

A process cartridge, which is an assembly of parts for forming the visible toner image, is removable from a main body of the image forming apparatus, and is a consumable to be replaced when the lifespan thereof is over. The process cartridge may have various structures such as a structure in which the photoreceptor, a developing roller supplying the toner to the photoreceptor, and an accommodating part accommodating the toner are integrally formed, a structure divided into an image cartridge including the photoreceptor and the developing roller, and a toner cartridge accommodating the toner, a structure divided into a photoreceptor cartridge including the photoreceptor, a developing cartridge including the developing roller, and the toner cartridge accommodating the toner, and the like.

The process cartridge is provided with a memory unit in which various kinds of information on the cartridge is stored. When the cartridge is attached to the main body, the memory unit may be electrically connected to the main body to communicate with the main body, and may transmit information of the cartridge to the main body. The memory unit includes a contact part which is electrically connected to a connection part of the main body.

In addition, the process cartridge should be supplied with a voltage to form an image. For such a voltage supply, the cartridge includes the contact part which is electrically connected to the connection part of the main body.

In order to connect the process cartridge with the main body, a cartridge support member having a plurality of cartridges attached thereto and supporting the cartridges to be movable to inside and outside positions of the main body of the image forming apparatus is used. In addition, an electrical contact point of the main body side is installed on a movement path of the support member in the inside of the main body to electrically connect the main body with the cartridge.

According to the related art, a connection and a separation of the electrical contact point between the main body and the cartridge were performed by opening and closing a door. In addition, the electrical contact point is generally provided only on one surface of the cartridge, such that the electrical contact point is installed on only one side surface of the main body. Therefore, when the door is opened, there was a difference in magnitudes of forces applied to left and right of the door. Such magnitude difference of the force degrades manipulability of the door, and causes a distortion in the door itself.

In addition, since the process cartridge seated on the cartridge support member was simply seated but not fixed, there was a possibility that the process cartridge moves inside the main body. This makes the connection between the electrical contact point of the main body side and the electrical contact point of the cartridge side unstable, and when the process cartridge is moved inside the main body and the contact of the electrical contact points is loosened, dusts or developed particles are caught into the loosened contact and an electrical contact terminal is contaminated.

SUMMARY

Exemplary embodiments of the disclosure overcome the above disadvantages and other disadvantages not described above. Also, the disclosure is not required to overcome the disadvantages described above, and an exemplary embodiment of the disclosure may not overcome any of the problems described above.

The disclosure provides an image forming apparatus in which an electrical contact point connection between a main body and a cartridge is stably maintained when a process cartridge is attached to or detached from the main body.

The disclosure also provides an image forming apparatus having improved manipulability by preventing a door and a connection link between the door and a cartridge support member from being deformed or damaged.

The disclosure also provides an image forming apparatus capable of preventing contamination of electrical contact parts of a main body and a cartridge of the image forming apparatus.

According to an aspect of the disclosure, an image forming apparatus may include a main body configured to include a door, a cartridge support member configured to have a process cartridge attachable thereto, wherein the process cartridge is provided with a plurality of first electrical contact points, and a holder configured to have a plurality of second electrical contact points which are electrically contactable to the plurality of first electrical contact points. The cartridge support member is moved from a first position to a second position in the main body when the door is opened, and is moved from the second position to the first position when the door is closed, the plurality of second electrical contact points are electrically connected to the plurality of first electrical contact points while the process cartridge is at the first position, while the process cartridge moves between the first position and the second position, and while the process cartridge is at the second position, and the holder electrically disconnects the plurality of second electrical contact points from the plurality of first electrical contact points when the door is opened and the cartridge support member is led to a third position outside the main body.

The plurality of first electrical contact points may be formed to have predetermined lengths along a movement direction between the first and second positions.

The holder may be elastically moved along a length direction of the process cartridge disposed in the main body.

The holder may include an interference protrusion which protrudes to an inside of the main body, and the interference protrusion may be pushed in an outer direction of the main body by the cartridge support member while the cartridge support member moves between the second position and the third position, and move the holder.

The interference protrusion may have an inclined surface formed on each of both sides thereof.

The holder may have an upper end portion which is hingeably connected to a portion of the main body.

The holder may include a hinge protrusion formed on each of both sides of an upper end portion thereof.

The holder may have an upper end portion which is formed integrally with a portion of the main body, and may be injection-moldable integrally with the portion of the main body.

The holder may be formed of a material having elasticity.

The holder may be elastically supported by an elastic member disposed at a rear portion thereof.

The elastic member may be electrically connected to the plurality of second electrical contact points.

The cartridge support member may include a groove into which the interference protrusion is inserted at the first and second positions, and guide surfaces inclined at both sides of the groove so as to correspond to the inclined surfaces of both sides of the interference protrusion.

A plurality of process cartridges may be attached to the cartridge support member, a plurality of holders may be provided to correspond to the plurality of process cartridges, at least one holder which is adjacent to the door among the plurality of holders may include an auxiliary interference protrusion formed to protrude from the surface from which the interference protrusion protrudes while being spaced apart from the interference protrusion, and the cartridge support member may include at least one auxiliary groove into which the auxiliary interference protrusion is inserted in a portion adjacent to the door.

The auxiliary interference protrusion may be disposed at a position farther from the door than the interference protrusion, and the auxiliary groove may be disposed at a position farther from the door than the groove.

The holder may include a slider slidably coupled in a length direction of the process cartridge and having the plurality of second electrical contact points disposed on a front surface thereof, an interference protrusion configured integrally with the slider, and an elastic member elastically supporting a rear surface of the slider and electrically connected to the plurality of second electrical contact points.

According to another aspect of the disclosure, an image forming apparatus may include a main body configured to include a door, a cartridge support member configured to be installed in the main body to be movable to first and second positions in the main body and a third position outside the main body, and to have a process cartridge attachable thereto, and a holder configured to be disposed to be movable in the main body. The holder is electrically connected to the process cartridge when the cartridge support member is positioned between the first and second positions in the main body, and is electrically disconnected from the process cartridge when the cartridge support member departs from the first and second positions.

The holder may include an interference protrusion which protrudes to an inside of the main body, the interference protrusion may be pushed in an outer direction of the main body by the cartridge support member when the cartridge support member moves between the second position and the third position, and move the holder, and the cartridge support member may include a groove into which the interference protrusion is inserted.

A plurality of process cartridges may be attached to the cartridge support member, a plurality of holders may be provided to correspond to the plurality of process cartridges, at least one holder which is adjacent to the door among the plurality of holders may include an auxiliary interference protrusion formed to protrude from the surface from which the interference protrusion protrudes while being spaced apart from the interference protrusion, and the cartridge support member may include at least one auxiliary groove into which the auxiliary interference protrusion is inserted in a portion adjacent to the door.

A portion of the holder may be hingeably connected to the main body.

According to another aspect of the disclosure, an image forming apparatus may include a main body configured to include a door at one side thereof, a cartridge support member configured to move between a first position and a second position in the main body according to opening and closing of the door, and to be movable from the second position to a third position which is led to an outside of the main body, a process cartridge configured to be detachably attached to the cartridge support member and to have a plurality of first electrical contact points disposed at one side thereof, wherein the plurality of first electrical contact points are formed along a movement direction between the first and second positions, a holder configured to be disposed in the main body to be movable according to a length direction of the process cartridge, and to have a plurality of second electrical contact points which are electrically in contact with the plurality of first electrical contact points, an interference protrusion configured to protrude to an inside of the main body, to be pushed in an outer direction of the main body by the cartridge support member while the cartridge support member moves between the second position and the third position, and to move the holder, and a groove configured to be formed in the cartridge support member so that the interference protrusion is inserted at the second position, wherein the plurality of second electrical contact points are electrically connected to the plurality of first electrical contact points while the process cartridge is at the first position, while the process cartridge moves from the first position to the second position, and while the process cartridge is at the second position, and are electrically disconnected from the plurality of first electrical contact points while the cartridge support member departs from the second position and moves to the third position and while the cartridge support member is at the third position.

According to the diverse exemplary embodiments of the disclosure, even though the cartridge support member is moved, the electrical contact between the main body and the cartridge may be stably maintained in the predetermined position and interval.

Further, since the cartridge support member and the body door are indirectly connected to each other, a difference in force applied to the left and right of the door does not occur and the distortion of the door does not occur. Thereby, manipulability and usability of the door may be improved.

It is possible to remove the contaminants such as the toner, dust, and the like, while sweeping the electrical contact point of the main body side and the electrical contact point of the cartridge side with each other, thereby it is possible to prevent the contact point terminal from being contaminated.

BRIEF DESCRIPTION OF THE DRAWINGS

The above and/or other aspects of the disclosure will be more apparent by describing certain exemplary embodiments of the disclosure with reference to the accompanying drawings, in which.

DETAILED DESCRIPTION

Figure 1:
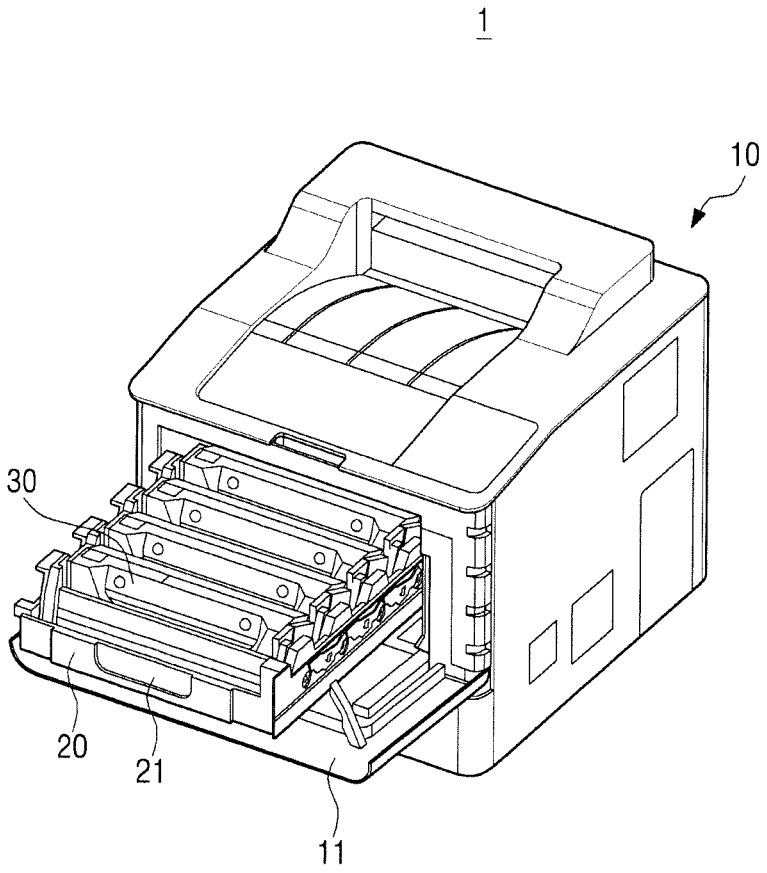
FIG. 1 is a perspective view schematically illustrating an image forming apparatus according to an exemplary embodiment of the disclosure.

Hereinafter, diverse exemplary embodiments of the disclosure will be described in more detail with reference to the accompanying drawings. However, it is to be understood that technologies mentioned in the disclosure are not limited to specific exemplary embodiments, but include various modifications, equivalents, and/or alternatives according to exemplary embodiments of the disclosure. Throughout the accompanying drawings, same or similar components will be denoted by same or similar reference numerals.

Figure 2:
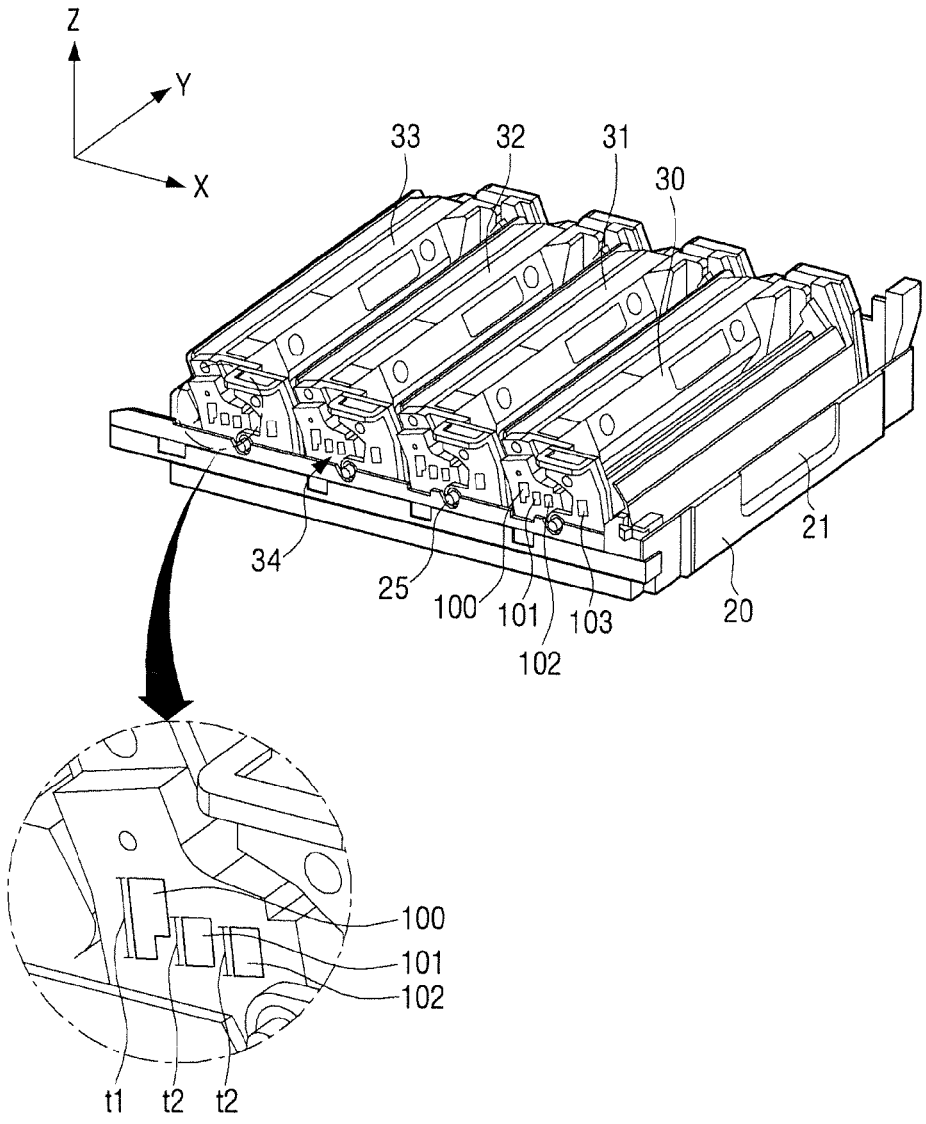
FIG. 2 is a perspective view illustrating a cartridge support member and a state in which process cartridges are attached to the cartridge support member.

FIG. 1 is a view schematically illustrating an image forming apparatus 1 according to an exemplary embodiment of the disclosure. FIG. 2 is a perspective view illustrating a cartridge support member 20 and process cartridges 30, 31, 32, and 33 which are inserted into a main body 10 of the image forming apparatus of FIG. 1.

Referring to FIG. 1, the image forming apparatus 1 is illustrated as a laser printer. However, the image forming apparatus 1 is not limited thereto, but may be a copier, a scanner, a facsimile, or the like, and may be a multi function peripheral (MFP) in which functions of the above-mentioned devices are integrated into a single apparatus. Hereinafter, for convenience of explanation, suppose that the image forming apparatus is the laser printer.

A door 11 is provided to one side surface of the main body 10 of the image forming apparatus. The door 11 is generally connected hingeably to one side surface of the main body as illustrated in FIG. 1, but is not necessarily limited thereto, and any door is sufficient as long as it may have the cartridge support member 20 inserted thereinto by opening an inner portion of the main body.

The cartridge support member 20 is slidably provided in the inner portion of the main body. In a case in which the door 11 is opened, a user may pull the cartridge support member 20 out of the main body 10 of the image forming apparatus or push the cartridge support member 20 in an opposite direction using a handle 21 of the cartridge support member.

Referring to FIG. 2, one or more process cartridges 30 may be attached to the cartridge support member 20. For example, when the image forming apparatus is implemented as a color laser printer, as the process cartridges 30, a plurality process cartridges 30, 31, 32, and 33 according to four colors of cyan, magenta, yellow, and black may be attached. The type, number, shape, and the like of the process cartridge may be variously modified according to the exemplary embodiments, but the disclosure will be described with reference to four process cartridges as illustrated in FIG. 2 for convenience of explanation.

The cartridge support member 20 is configured to be slide-movable along an X axis as illustrated in FIG. 2.

The process cartridge 30 is attachable to or detachable from the cartridge support member 20 along a Z axis, and the cartridge support member 20 may be provided with a groove 25 that prevents the process cartridge 30 from being moved in the X axis direction. In addition, an inside of the cartridge support member 20 may have a shape (not shown) similar to an outer portion shape of a lower portion of the process cartridge 30.

As illustrated in FIG. 2, a length direction of the process cartridge 30 is defined as a Y axis, and coincides with a movement direction of a holder 40 to be described below.

Hereinafter, according to the disclosure, a position of the cartridge support member 20 when the process cartridge 30 is in a state in which it may perform an image formation in the main body 10 of the image forming apparatus is defined as a first position, and a position of the cartridge support member 20 in a state in which the process cartridge 30 departs from the first position, but is positioned in the main body 10 of the image forming apparatus is defined as a second position. In addition, a position of the cartridge support member 20 in a state in which the cartridge support member 20 is led from the inner portion of the main body 10 of the image forming apparatus and is put on an outer side of the main body is defined as a third position.

The cartridge support member 20 which is moved to the first to third positions will be described in more detail with reference to FIGS. 3 to 6B.

Figure 3:
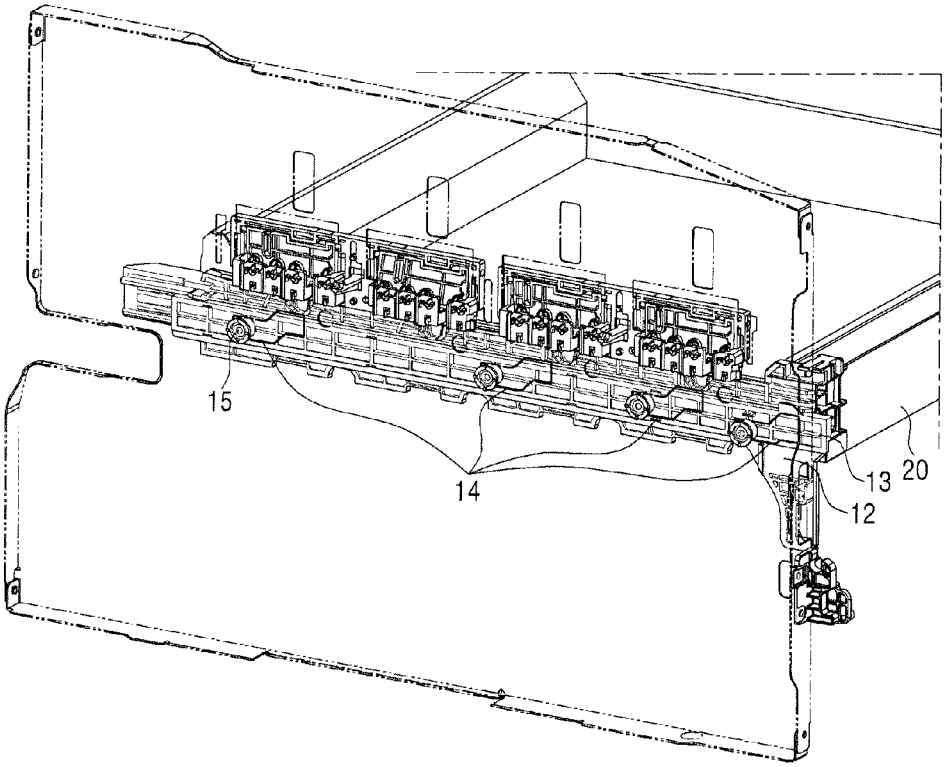
FIG. 3 is a view illustrating a state in which a guide rail is connected to a guide groove.
Figure 4:
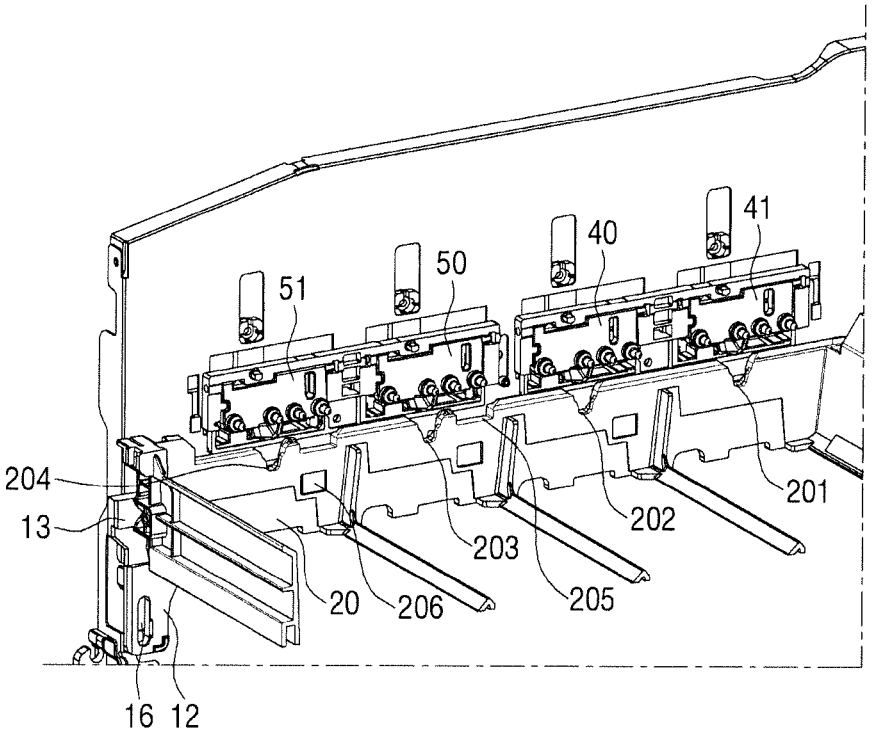
FIG. 4 is a view illustrating the cartridge support member seated on the guide rail.

FIG. 3 is a view of a state in which a guide rail 13 is connected to a guide groove 14 viewed from an outside of the main body, and FIG. 4 is a view of the cartridge support member 20 seated on the guide rail 13 viewed from an inside of the main body.

Referring to FIGS. 3 and 4, the guide rail 13 is provided in the inside of the main body. The guide rail 13 is configured to be coupled to a connection bolt 15 inserted into the guide groove 14 and to be movable in the Z axis direction along the guide groove 14.

In addition, the guide rail 13 is configured to be movable according to opening and closing of the door 11 through a connection part 12.

Figure 6A:
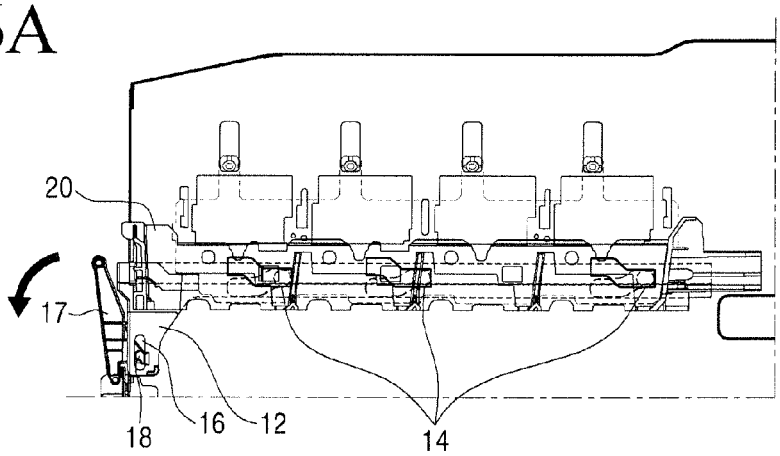
FIGS. 6A and 6B are views illustrating operations of a connection line, a guide rail and a cartridge support member according to opening and closing of a door.
Figure 6B:
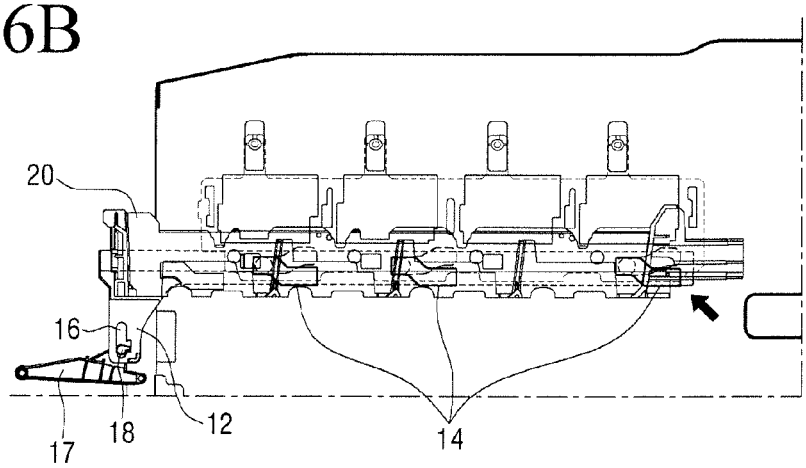

FIG. 6A illustrates states of a door connection link 17 and the cartridge support member 20 in a state in which the door 11 is closed, and FIG. 6B illustrates states of the door connection link 17 and the cartridge support member 20 in a state in which the door 11 is opened.

The door connection link 17 illustrated in FIGS. 6A and 6B has a protrusion 18 formed at one end thereof. The protrusion 18 of the door connection link is inserted into the groove 16 formed in the connection part 12 of the guide rail.

Therefore, as illustrated in FIG. 6B, when the door 11 is opened, the protrusion 18 of the door connection link pulls the groove 16 formed in the connection part 12 of the guide rail in a direction in which the door 11 is opened, and the guide rail 13 which is integrally connected to the connection part 12 is moved along a guide groove 14. Therefore, the guide rail 13 ascends in the Z axis direction while being moved in a direction of the door 11 along the guide groove 14.

Conversely, as illustrated in FIG. 6A, when the door is closed, the protrusion 18 of the door connection link pushes the groove 16 formed in the connection part 12 of the guide rail in a direction of the inside of the main body 10 of the image forming apparatus, and the guide rail 13 is moved in the direction of the inside of the main body of the image forming apparatus along the guide groove 14. Therefore, the guide rail 13 descends in the Z axis direction while being moved in the direction of the inside of the main body along the guide groove 14.

Referring to FIG. 4, the cartridge support member 20 is configured to be seated on the guide rail 13 installed in the main body side and to be slidable on the guide rail 13. Therefore, as the guide rail 13 is moved, the cartridge support member 20 may also be moved in the Z axis direction like the guide rail 13.

As the door 11 is closed and the guide rail 13 descends in the Z axis direction, a position of state in which the cartridge support member 20 descends in the main body is referred to as the first position. The first position is referred to as a state in which the process cartridge 30 may perform the image formation.

Conversely, as the door 11 is opened and the guide rail 13 ascends in the Z axis direction, a position of state in which the cartridge support member 20 ascends in the main body is referred to as the second position. The second position, which is a state in which the cartridge support member 20 departs from the first position, is referred to as a state in which the cartridge support member 20 and the process cartridge 30 are still positioned in the main body, but may not perform the image formation.

The cartridge support member 20 is configured not to be fixed on the guide rail 13 and simply be seated thereon to be slidable. Therefore, when the door 11 is opened, the cartridge support member 20 departs from the first position and ascends from the first position to be positioned at the second position, and may be pulled out of the main body of the image forming apparatus using the handle 21 provided to the cartridge support member. As such, a position when the cartridge support member 20 is put outside the main body is referred to as a third position.

As such, the cartridge support member 20 is seated on the guide rail 13 and is indirectly connected to the door 11, and is moved in the Z axis direction together with the movement of the guide rail 13 according to the opening and closing of the door 11. In addition, the guide rail 13 may be provided to both sides of the cartridge support member 20 (not shown).

Therefore, according to the disclosure, a difference of forces applied to the left and right of the door 11 does not occur and excessive stress does not occur in the door 11, thereby preventing the distortion of the door 11.

A structure and an operation in which the main body 10 and the process cartridge 30 are electrically connected to each other and are separated from each other will be described in detail with reference to FIGS. 2 to 10B.

Referring to FIG. 2, a first electrical contact point 100, which is an electrical contact point of the process cartridge side, may be formed in one side surface 34 of the process cartridge. The first electrical contact point 100 is generally provided as a plurality of electrical contact points 100, 101, 102, and 103 so that a voltage may be supplied to the process cartridge. However, the first electrical contact point is not limited to supplying the voltage, but may also be used as an electrical contact point of a memory unit in which various types of information on the process cartridge are stored. The electrical contact point for the memory unit may also be formed in one surface 34 of the process cartridge while having a predetermined interval from the first electrical contact point, but is not illustrated in the drawings.

Figure 5:
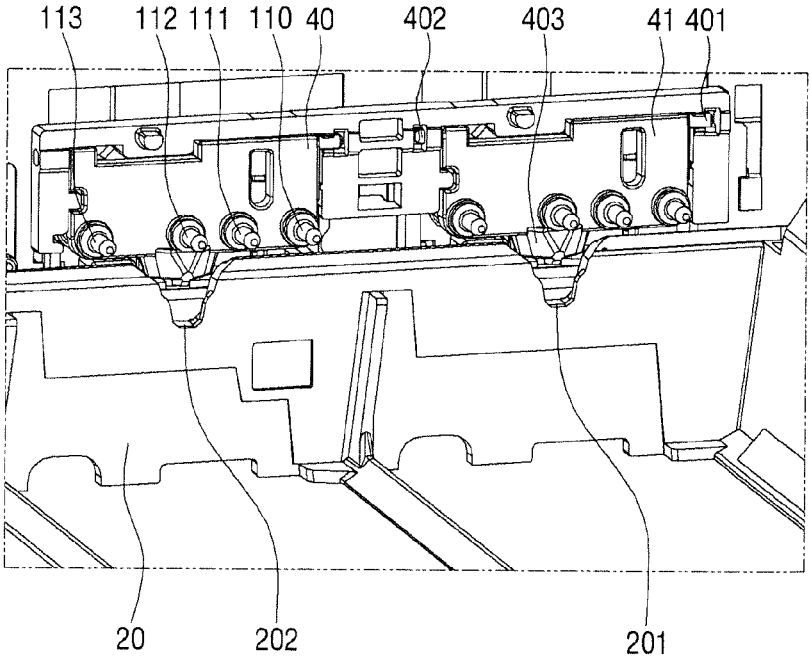
FIG. 5 is an enlarged view of a holder and a cartridge support member according to an exemplary embodiment of the disclosure.

FIG. 5 is a perspective view illustrating a configuration of a holder 40 according to an exemplary embodiment of the disclosure.

The holder 40 is provided in the inside of the main body to be movable in the Y axis direction, which is the length direction of the process cartridge. In addition, a surface facing the process cartridge 30 in the inside of the main body may be defined as a front surface of the holder 40.

A second electrical contact point 110, which is an electrical contact point of the main body side, may be formed as a plurality of electrical contact points 110, 111, 112, and 113 in the front surface of the holder 40.

The holder 40 is formed with a plurality of holes into which a plurality of second electrical contact points 110, 111, 112, and 113 may be inserted, and the second electrical contact points are inserted into the holes and fixed.

That is, the holder 40 may be provided on the inside of the main body facing the first electrical contact point 100 for connection between the first electrical contact point 100 and the second electrical contact point 110, and a plurality of holders 40 may be provided.

In addition, in a case in which the first electrical contact points 100 are formed in both side surfaces of the process cartridge 30, the holder 40 may be formed on left and right inside surfaces of the main body so as to face the first electrical contact points 100.

In addition, the holder may include a separate electrical contact point for electrical connection with the memory unit other than the second electrical contact point 110, but the separate electrical contact point is not illustrated in the drawings.

The image forming apparatus according to an exemplary embodiment of the disclosure has the first electrical contact point 100 and the second electrical contact point 110 which are electrically connected while the cartridge support member 20 is at the first position, while the cartridge support member 20 is at the second position, and while the cartridge support member 20 is moved between the first position and the second position. In addition, while the cartridge support member 20 is moved from the second position to the third position and while the cartridge support member 20 is at the third position, the first electrical contact point 100 and the second electrical contact point 110 are electrically separated from each other.

This is to maintain an electrically stable connection between the main body 10 and the process cartridge 30 regardless of the opening and closing of the door 11.

Referring to FIG. 2, the plurality of first electrical contact points 100, 101, 102, and 103 may be formed to have predetermined lengths t1 and t2. This is to prevent a disconnection of the electrical connection between the first electrical contact point 100 and the second electrical contact point 110, as relative positions of the first electrical contact point 100 and the second electrical contact point 110 are changed while the cartridge support member 20 is moved between the first and second positions.

Therefore, the predetermined lengths t1 and t2 for the plurality of first electrical contact points 100, 101, 102, and 103 are preferably equal to a length that the cartridge support member 20 is moved between the first and second positions.

In FIG. 2, t1 may be formed to be longer than t2, and the predetermined length t2 is at least equal to the length that the cartridge support member 20 is moved between the first and second positions.

Referring to FIGS. 4 and 5, an upper portion of the holder 40 according to an exemplary embodiment of the disclosure is hingeably connected to the main body so that the holder 40 is elastically movable along the Y axis direction.

The holder 40 may include hinge protrusions 401 and 402 in each of both sides of an upper end portion thereof, and the hinge protrusions 401 and 402 may be hingeably connected to the main body.

The holder 40 is rotatable or movable along the Y axis direction about a rotation axis on which the hinge protrusions 401 and 402 rotate.

In addition, an elastic member 300 elastically supporting the holder 40 is disposed on a rear surface of the holder 40.

Figure 8A:
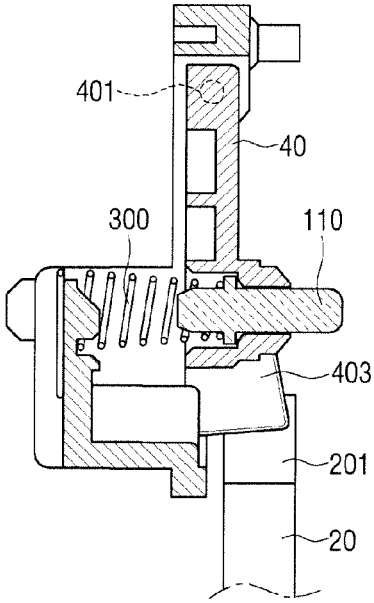
FIGS. 8A and 8B are cross-sectional views taken along the line A-A' of FIG. 7B and the line B-B' of FIG. 7C, each of which illustrates a movement of the holder.
Figure 8B:
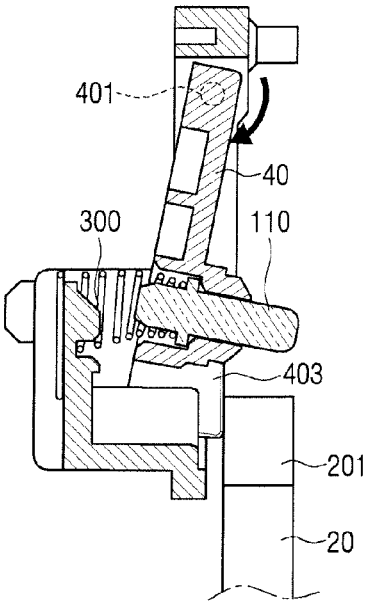

As the elastic member 300, various kinds of springs may be generally used. In particular, as illustrated in FIGS. 8A and 8B, a coil spring is preferably used. However, the elastic member 300 is not limited thereto. In the disclosure, it is assumed that the coil spring is used as the elastic member 300 for convenience of explanation.

The elastic member 300 may stably fix the holder 40 and the process cartridge 30 to the cartridge support member 20 by elastically supporting the holder 40 on the back and pressing the process cartridge 30 in the Y axis direction.

In addition, the elastic member 300 may be electrically connected to the plurality of second electrical contact points 110, 111, 112, and 113. In order to enable such an electrical connection, the elastic member 300 is preferably formed of a metal material having excellent electrical conductivity, and an SUS material may be generally used. However, as long as a material is an electrically conductive material, all materials such as a metal and a conductor may be used and are not limited to specific materials.

The elastic member 300 which is electrically connected to the second electrical contact point 110 may electrically connect a circuit board (not shown) of the main body side and the second electrical contact point 110 to each other. In addition, in a case in which the first electrical contact point 100 is connected to the second electrical contact point 110, the first electrical contact point 100 may also be connected to the circuit board of the main body side through the elastic member 300.

Therefore, the second electrical contact point 110 which is electrically connected to the circuit board of the main body side through the elastic member 300 may be used to transfer data to the memory unit, or the like in addition to supplying the voltage to the process cartridge 30 through the first electrical contact point 100.

An interference protrusion 403 is formed on a lower end portion of the holder 40 according to an exemplary embodiment of the disclosure.

The interference protrusion 403 will be described with reference to FIGS. 5, 7A to 7C, and 8A and 8B.

Figure 7A:
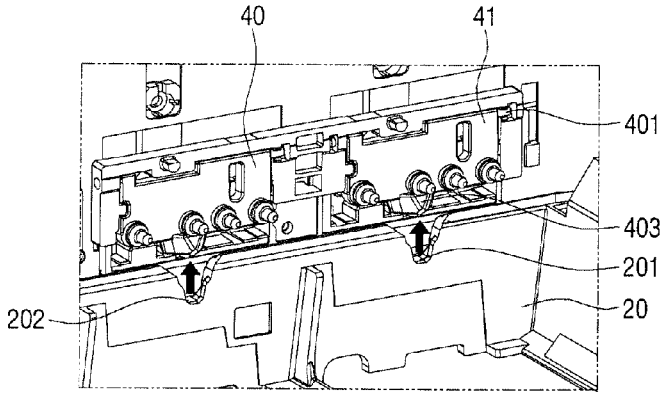
FIGS. 7A to 7C are views illustrating the cartridge support member and the holder which are moved to first to third positions.
Figure 7B:
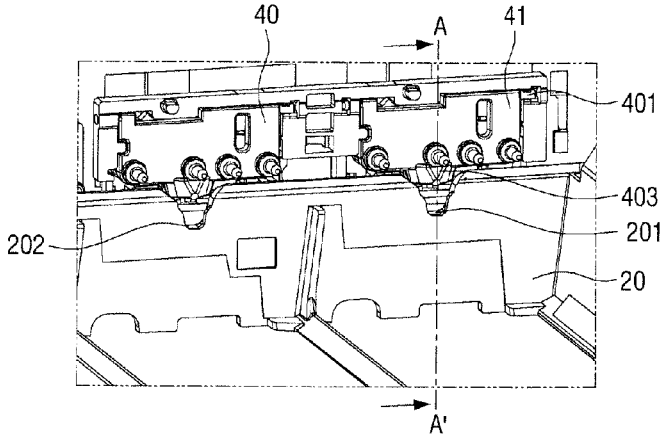
Figure 7C:
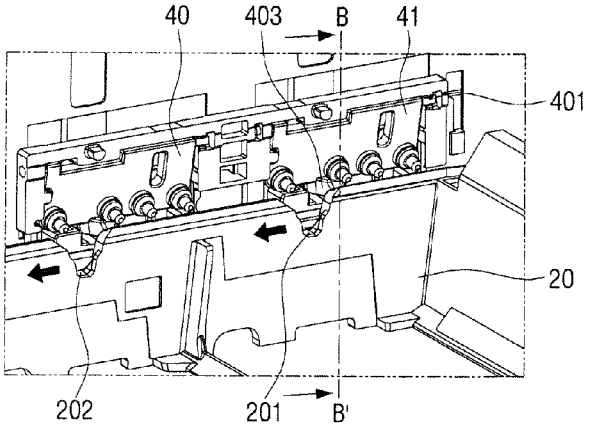

FIGS. 8A and 8B are views illustrating cross sections of the holder 40 taken along the line A-A' of FIG. 7B and the line B-B' of FIG. 7C, each of which illustrates a movement of the holder 40.

Referring to FIGS. 8A and 8B, the interference protrusion 403 is configured to be formed to protrude to the inside of the main body and interfere with the cartridge support member 20.

When the cartridge support member 20 is moved from the second position to the third position, the interference protrusion 403 is pushed by the cartridge support member 20 and moves the holder 40 in an outer direction of the main body of the image forming apparatus. Therefore, the image forming apparatus 1 according to an exemplary embodiment of the disclosure disconnects the electrical connection between first and second electrical contact points 100 and 110 while the cartridge support member 20 departs from the second position and is moved to the third position, and when the cartridge support member 20 is at the third position.

An inclined surface is each formed on both sides of the interference protrusion 403, thereby making it possible to minimize resistance force caused by the interference protrusion 403, when the cartridge support member 20 slide-moves between the second and third positions. Therefore, the user may use the cartridge support member 20 without large inconvenience in operating the cartridge support member 20.

Referring to FIGS. 5 to 7C, a groove 201 into which the interference protrusion 403 is inserted is formed in the cartridge support member 20. The cartridge support member 20 may be installed with a plurality of grooves 201 and 202 corresponding to the interference protrusion 403 included in the respective holders 40 and 41.

The image forming apparatus 1 according to an exemplary embodiment of the disclosure maintains the electrical connection between the first and second electrical contact points 100 and 110, when the cartridge support member 20 is at the first and second positions. Therefore, when the cartridge support member 20 departs from the first position and is at the second position, which is the ascended position, the interference protrusion 403 is inserted into the groove 201 so that the holder 40 is not moved in the outer direction of the main body due to the interference protrusion 403 pushed by the cartridge support member 20.

In the case in which the interference protrusion 403 is inserted into the groove 201, since the holder 40 is not moved in the outer direction of the main body even though the cartridge support member 20 is at the second position, the process cartridge 30 attached to the cartridge support member 20 which is at the second position may be continuously pressed by an elastic support of the elastic member 300, and a contact between the first electrical contact point 100 and the second electrical contact point 110 may be maintained.

Figure 9:
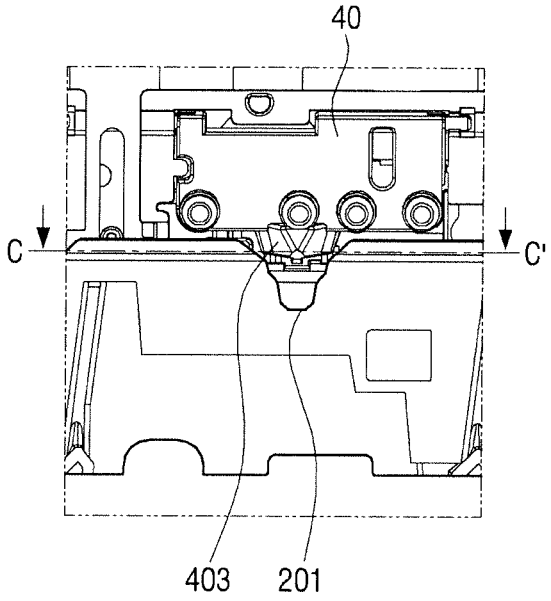
FIG. 9 is a front view of a holder according to an exemplary embodiment of the disclosure.
Figure 10A:
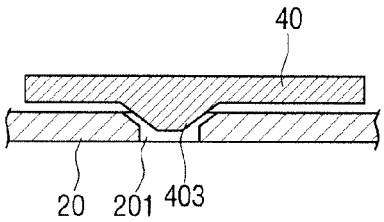
FIGS. 10A and 10B are cross-sectional views taken along the line C-C' of FIG. 9, each of which illustrates an operation of an interference protrusion separated from a groove.
Figure 10B:
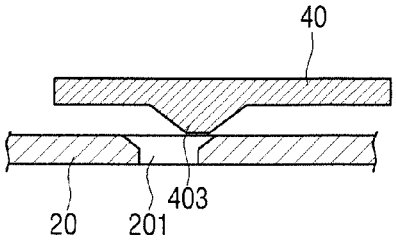

FIGS. 10A and 10B are cross-sectional views of the holder 40 taken along the line C-C' of FIG. 9, each of which illustrates a movement of the interference protrusion.

Referring to FIGS. 10A and 10B, the groove 201 may form inclined guide surfaces corresponding to the inclined surfaces on both sides of the interference protrusion 403.

When the cartridge support member 20 is moved between the second and third positions, the interference protrusion 403 may be easily inserted into or depart from the groove 201 by the guide surfaces formed in the groove 201.

In addition, when the cartridge support member 20 slide-moves between the second and third positions due to the guide surfaces formed in the groove 201, friction resistance force caused by the interference protrusion 403 is reduced.

FIGS. 7A to 7C are views illustrating the cartridge support member and the holder which are moved to first to third positions.

FIG. 7A illustrates a case in which the cartridge support member 20 is at the first position, FIG. 7B illustrates a case in which the cartridge support member 20 is at the second position, and FIG. 7C illustrates a case in which the cartridge support member 20 departs from the second position and is in a section in which it is moved to the third position.

In FIGS. 7A to 7C, in order to clearly describe a motion of the holder 40, the elastic member 300 and the process cartridge 30 are not illustrated.

FIG. 7A illustrates a state in which the cartridge support member 20 is at the first position. At the first position, the holder 40 is in a state in which it presses the second electrical contact point 110 in the Y axis direction by the elastic member 300 so that the second electrical contact point 110 is in contact with the first electrical contact point 100 at the same time of pressing the process cartridge 30.

At the first position, since the cartridge support member 20 is in the descended state so that the process cartridge 30 may perform the image formation, the interference protrusion 403 included in the holder is in a state in which it is not inserted into the groove 201 formed in the cartridge support member 20.

FIG. 7B illustrates a state in which the cartridge support member 20 seated on the guide rail 13 as the door 11 is opened and the guide rail 13 ascends and the cartridge support member 20 departs from the first position and ascends to the second position.

Also, at the second position, in order to maintain a continued contact state between the first and second electrical contact points 100 and 110, as illustrated in FIG. 10A, the interference protrusion 403 included in the holder is inserted into the groove 201 formed in the cartridge support member 20.

Since the interference protrusion 403 of the holder 40 does not interfere with the cartridge support member 20 at the second position, the interference protrusion 403 is not pushed in the outer direction of the main body, and as illustrated in FIG. 8A, the interference protrusion 403 is in a state in which it presses the second electrical contact point 110 in the Y axis direction by the elastic member 300 so that the second electrical contact point 110 is in contact with the first electrical contact point 100.

FIG. 7C illustrates a state in which the cartridge support member 20 departs from the second position and is in a section for moving to the third position.

The cartridge support member 20 slides in the X axis direction, and the interference protrusion 403 installed on the holder 40 is pushed by the cartridge support member 20.

As illustrated in FIGS. 8B and 10B, the interference protrusion 403 is pushed in the outer direction of the main body along the guide surfaces formed in the groove 201. In addition, as the interference protrusion 403 formed at the lower end portion is pushed, the holder 40 is rotated in the outer direction of the main body about the rotation axis of a hinge protrusion 401, and the second electrical contact point 110 is separated from the first electrical contact point 100.

Therefore, the image forming apparatus 1 according to an exemplary embodiment of the disclosure electrically connects the first and second electrical contact points 100 and 110 to each other when the cartridge support member 20 to which the process cartridge 30 is attached is at the first position, is in a section in which it moves from the first position to the second position, and is at the second position, and disconnects the electrical connection between the first and second electrical contact points 100 and 110 when the cartridge support member 20 departs from the second position and is in a section in which it moves to the third position, and is at the third position.

In addition, in a case in which the process cartridge 30 is moved from the first position to the second position, since the second electrical contact point 110 fixed to the holder 40 of the main body slide-moves on a first electrical contact point surface at the same time of maintaining the electrical connection with the first electrical contact point 100, the first electrical contact point 100 is swept. This moves contaminants such as toner and dust stained on the first electrical contact point 100, thereby making it possible to stably maintain the electrical connection between the first and second electrical contact points.

As illustrated in FIG. 2, the image forming apparatus 1 according to the disclosure may have the plurality of process cartridges 30, 31, 32, and 33 attached to the cartridge support member 20.

In addition, a plurality of holders 40, 41, 50, and 51 corresponding to the plurality of process cartridges are provided.

An image forming apparatus including a holder 50 according to another exemplary embodiment of the disclosure will be described with reference to FIGS. 11 to 13B.

Figure 11:
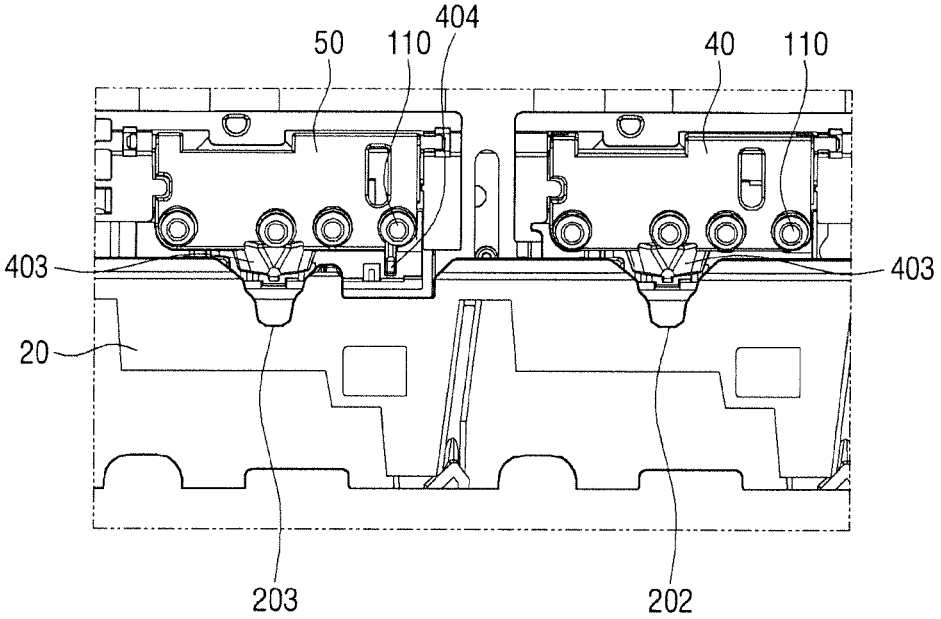
FIG. 11 is a front view of a holder and a cartridge support member according to another exemplary embodiment of the disclosure.
Figure 13A:
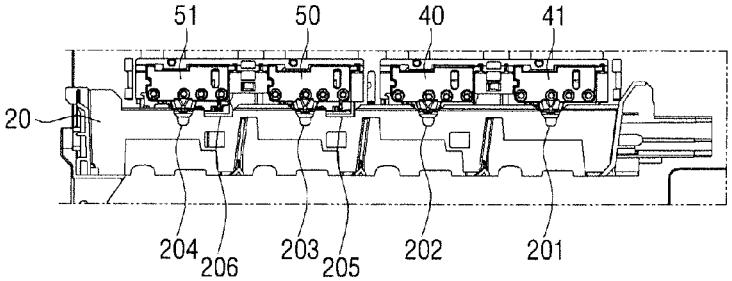
FIGS. 13A and 13B are views illustrating that the holder and the cartridge support member according to another exemplary embodiment of the disclosure are moved from a second position to a third position.
Figure 13B:
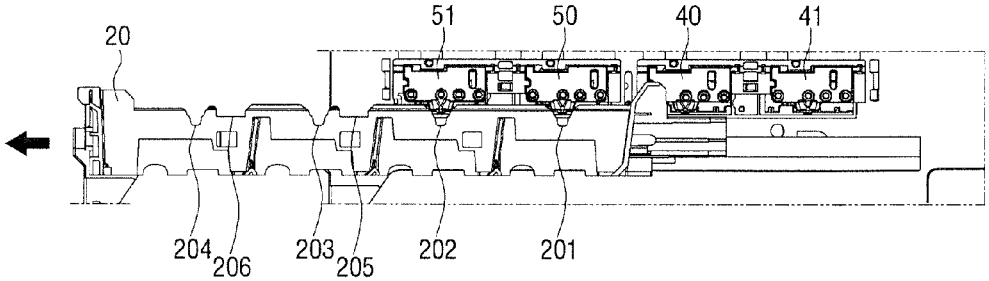

As illustrated in FIGS. 11, 13A and 13B, the holder 50 which is adjacent to the door 11 among the plurality of holders 40, 41, 50, and 51 corresponding to the plurality of process cartridges may further include an auxiliary interference protrusion 404 at the lower end portion, which is a surface from which the interference protrusion 403 protrudes.

The auxiliary interference protrusion 404 is formed to be spaced apart from the interference protrusion 403, and is configured to be formed to protrude to the inside of the main body so that it may be pushed by the cartridge support member 20. In addition, the auxiliary interference protrusion 404 is preferably disposed at a position farther from the door 11 than the interference protrusion 403.

Figure 12:
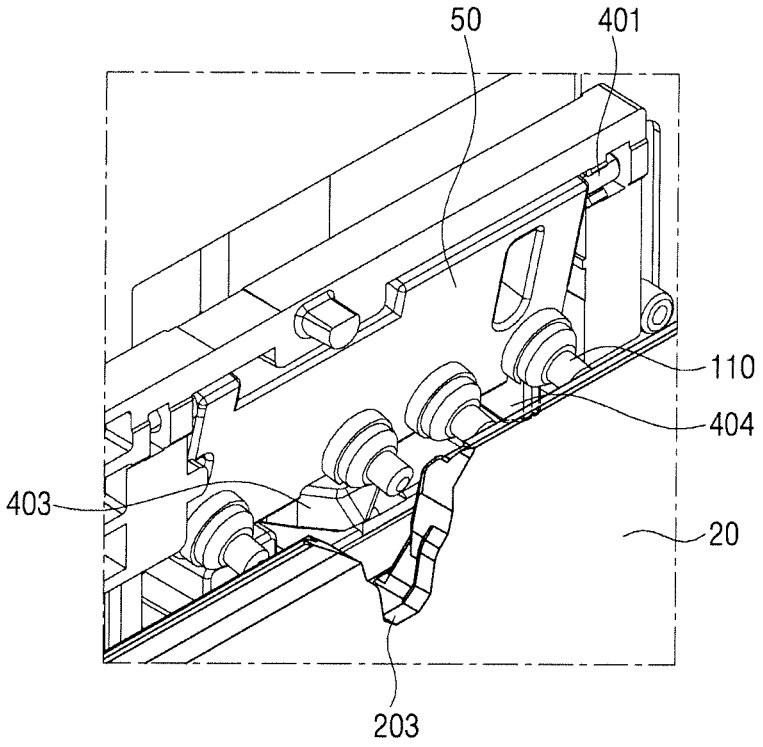
FIG. 12 is a perspective view illustrating an operation in which an auxiliary interference protrusion interferes with the cartridge support member.

Referring to FIGS. 12, 13A, and 13B, when the cartridge support member 20 is inserted into the second position of the inside of the main body from the third position of the outside of the main body, the auxiliary interference protrusion 404 is pushed by the cartridge support member 20, thereby preventing the holders 50 and 51 from being moved to the inside of the main body.

In addition, even in the case in which the cartridge support member 20 is moved from the second position to the third position, the auxiliary interference protrusion 404 is pushed by the cartridge support member 20, thereby preventing the holders 50 and 51 from being moved to the inside of the main body.

The auxiliary interference protrusions 404 may prevent that the interference protrusions 403 included in the holders 50 and 51 adjacent to the door 11 are inserted into the grooves 201 and 202 formed in the cartridge support member and interfere the sliding-movement of the cartridge support member 20.

In addition, in order to electrically connect the first electrical contact point 100 and the second electrical contact point 110 to each other in a state in which the cartridge support member 20 is compactly inserted into the second position, the auxiliary protrusion 404 does not need to be pushed by the cartridge support member 20.

Therefore, auxiliary grooves 205 and 206 into which the auxiliary interference protrusions 404 are inserted are formed in portions of the cartridge support member 20 corresponding to the holders 50 and 51 on which the auxiliary interference protrusions 404 are formed. That is, the auxiliary grooves 205 and 206 are formed in the portions of the cartridge support member 20 corresponding to the positions of the auxiliary interference protrusions of the holders 50 and 51 adjacent to the door 11.

The auxiliary grooves 205 and 206 are preferably disposed at positions farther from the door 11 than the grooves 203 and 204.

When the cartridge support member 20 is compactly inserted into the second position, the auxiliary interference protrusions 404 are inserted into the auxiliary grooves 205 and 206, thereby making it possible for the holders 50 and 51 to press the process cartridges 32 and 33 in the Y axis direction.

The auxiliary interference protrusion 404 may be included in one or more holders 50, and may also be included in all holders 40, 41, 50, and 51, but is preferably included in each of two holders 50 and 51 adjacent to the door 11 for simplification of a manufacturing process, a reduction of manufacturing costs, and manipulability improvement of the cartridge support member 20.

Figure 14:
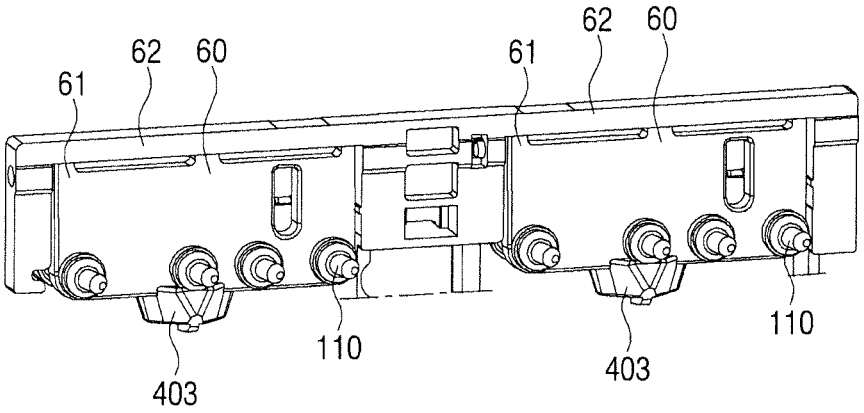
FIG. 14 is a perspective view illustrating a holder according to still another exemplary embodiment of the disclosure.

FIG. 14 illustrates a holder 60 according to still another exemplary embodiment of the disclosure.

Since only a configuration of the holder 60 is different from the exemplary embodiment described above, the detailed configuration and operation of the cartridge support member 20 will be omitted and only the holder 60 will be described.

The holder 60 according to still another exemplary embodiment of the disclosure has an upper end portion 61 which is formed integrally with a portion 62 of the main body.

The holder 60 may be formed of a material having elasticity, and may be generally formed of a resin material such as plastic. In addition, the holder 60 may be collectively injection-molded with the portion 62 of the main body. Therefore, the manufacturing process is simplified, thereby reducing manufacturing costs and manufacturing time.

The holder 60 has a rear portion which is elastically supported by the elastic member 300, and is formed of a material having elasticity, and since the upper end portion 61 of the holder and the portion 62 of the main body are only connected to each other, the holder 60 is hingeable about the upper end portion 61 of the holder.

In addition, the elastic member 300 may be electrically connected to the second electrical contact point 110, and for electrical connection, the elastic member 300 may be formed of a material having electrical conductivity.

An interference protrusion 403 is formed on the holder 60. In addition, the interference protrusion 403 may be collectively injection-molded with the holder 60 and the portion 62 of the main body, and may be formed integrally with the holder 60 and the portion 62 of the main body. Therefore, the manufacturing process is simplified, thereby reducing manufacturing costs and manufacturing time.

When the interference protrusion 403 is pushed by the cartridge support member 20, the holder 60 is moved in the outer direction of the main body, and when the interference protrusion 403 is inserted into the groove 201, the holder 60 presses the process cartridge 30 in the Y axis direction by the elastic member 300.

Figure 15:
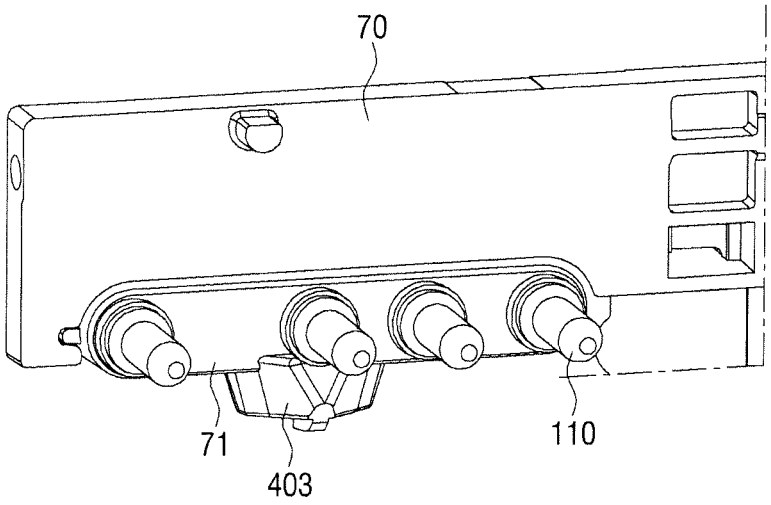
FIG. 15 is a perspective view illustrating a holder according to still another exemplary embodiment of the disclosure.

FIG. 15 illustrates a holder 70 according to still another exemplary embodiment of the disclosure.

Since only a configuration of the holder 70 is different from the exemplary embodiment described above, the detailed configuration and operation of the cartridge support member 20 will be omitted and only the holder 70 will be described.

The holder 70 according to still another exemplary embodiment of the disclosure is formed integrally with the main body.

The holder 70 may include a slider 71 which is slidable in the Y axis direction, which is the length direction of the process cartridge.

A groove in which the slider 71 is slidably formed in the holder 70. In addition, the slider 71 is configured to be inserted into the groove formed in the holder 70 and to be slidable along the groove.

The plurality of second electrical contact points 110 are disposed on the slider 71 to be fixed thereto, and the interference protrusion 403 is formed integrally with the slider 71.

A rear surface of the slider 71 is elastically supported by the elastic member 300, and presses the process cartridge 30 and allows the first and second electrical contact points 100 and 110 to be in contact with each other when the cartridge support member 20 is at the first position, is in the section in which it moves between the first position and the second position, and is at the second position at which the interference protrusion 403 is inserted into the groove 201.

In addition, the elastic member 300 may be electrically connected to the second electrical contact point 110, and the elastic member 300 may be formed of a material having electrical conductivity.

Hereinabove, although the disclosure has been described with reference to the exemplary embodiments thereof, those skilled in the art will appreciate that various modifications, additions and substitutions are possible, without departing from the scope and spirit of the disclosure as disclosed in the accompanying claims.

What is claimed is:

1. An image forming apparatus, comprising:

a main body configured to have a door;

a cartridge support member configured to have a process cartridge, provided with a plurality of first electrical contact points, attachable to the cartridge support member; and a holder configured to have a plurality of second electrical contact points electrically contactable to the plurality of first electrical contact points, wherein the cartridge support member is configured to be moved from a first position to a second position in the main body when the door is moved from a closed position to an open position, and to be moved from the second position to the first position when the door is moved from the open position to the closed position, when the process cartridge is attached to the cartridge support member, the holder is configured such that the plurality of second electrical contact points are electrically connected to the plurality of first electrical contact points while the cartridge support member is at the first position, while the cartridge support member moves between the first position and the second position, and while the cartridge support member is at the second position, and when the process cartridge is attached to the cartridge support member, the holder is further configured such that the plurality of second electrical contact points are disconnected from the plurality of first electrical contact points when the door is in the open position and the cartridge support member is moved from the second position to a third position outside the main body.

2. The image forming apparatus as claimed in claim 1, wherein the plurality of first electrical contact points have predetermined lengths along a movement direction between the first and second positions.

3. The image forming apparatus as claimed in claim 2, wherein the holder includes:

a slider slidably coupled in a length direction of the process cartridge and having the plurality of second electrical contact points disposed on a front surface thereof, an interference protrusion configured integrally with the slider, and an elastic member elastically supporting a rear surface of the slider and electrically connected to the plurality of second electrical contact points.

4. The image forming apparatus as claimed in claim 1, wherein the holder is elastically moved along a length direction of the process cartridge disposed in the main body.

5. The image forming apparatus as claimed in claim 4, wherein the holder includes an interference protrusion which protrudes to an inside of the main body, and the interference protrusion is configured to be pushed in an outer direction of the main body by the cartridge support member while the cartridge support member moves between the second position and the third position, and to move the holder.

6. The image forming apparatus as claimed in claim 5, wherein the interference protrusion is provided with an inclined surface on opposite sides thereof.

7. The image forming apparatus as claimed in claim 6, wherein the holder includes a hinge protrusion on opposite sides of an upper end portion thereof.

8. The image forming apparatus as claimed in claim 6, wherein the holder has an upper end portion which is integrally formed with a portion of the main body, and the upper end portion of the holder and the portion of the main body are injection-molded in an integral manner with one another.

9. The image forming apparatus as claimed in claim 8, wherein the holder is formed of a material having elasticity.

10. The image forming apparatus as claimed in claim 6, wherein the cartridge support member includes:

a groove into which the interference protrusion is inserted when the cartridge support member is at the second position, and an inclined guide surface provided at opposite sides of the groove so as to correspond to the inclined surface provided at opposite sides of the interference protrusion.

11. The image forming apparatus as claimed in claim 5, wherein the holder has an upper end portion which is hingeably connected to a portion of the main body.

12. The image forming apparatus as claimed in claim 5, wherein the cartridge support member is configured to be attachable to a plurality of process cartridges, a plurality of holders are provided to correspond to the plurality of process cartridges, at least one holder adjacent to the door among the plurality of holders includes an auxiliary interference protrusion to protrude from a same surface from which the interference protrusion protrudes while being spaced apart from the interference protrusion, and the cartridge support member includes at least one auxiliary groove, disposed in a portion of the cartridge support member adjacent to the door, into which the auxiliary interference protrusion is insertable.

13. The image forming apparatus as claimed in claim 12, wherein the auxiliary interference protrusion is disposed at a position farther from the door than the interference protrusion, and the auxiliary groove is disposed at a position farther from the door than the groove.

14. The image forming apparatus as claimed in claim 4, further comprising an elastic member, disposed at a rear portion of the holder, to elastically support the holder.

15. The image forming apparatus as claimed in claim 14, wherein the elastic member is electrically connected to the plurality of second electrical contact points.

16. An image forming apparatus, comprising:

a main body configured to have a door;

a cartridge support member configured to be installed in the main body to be movable to first and second positions in the main body and to a third position outside the main body, and to have a process cartridge attachable thereto; and a holder configured to be movable in the main body, to be electrically connected to the process cartridge when the process cartridge is attached to the cartridge support member and the cartridge support member is positioned between the first and second positions in the main body, and to be electrically disconnected from the process cartridge when the process cartridge is attached to the cartridge support member and the cartridge support member departs from the second position to the third position.

17. The image forming apparatus as claimed in claim 16, wherein the holder includes an interference protrusion which protrudes to an inside of the main body, the interference protrusion is configured to be pushed in an outer direction of the main body by the cartridge support member when the cartridge support member moves between the second position and the third position, and to move the holder, and the cartridge support member includes a groove into which the interference protrusion is insertable.

18. The image forming apparatus as claimed in claim 17, wherein the cartridge support member is configured to be attachable to a plurality of process cartridges, a plurality of holders are provided to correspond to the plurality of process cartridges, at least one holder adjacent to the door among the plurality of holders includes an auxiliary interference protrusion to protrude from a same surface from which the interference protrusion protrudes while being spaced apart from the interference protrusion, and the cartridge support member includes at least one auxiliary groove, disposed in a portion of the cartridge support member adjacent to the door, into which the auxiliary interference protrusion is insertable.

19. The image forming apparatus as claimed in claim 16, wherein a portion of the holder is hingeably connected to the main body.

20. An image forming apparatus, comprising:

a main body configured to have a door;

a cartridge support member configured to move between a first position and a second position in the main body according to an opening and closing of the door, and to be movable from the second position to a third position outside of the main body;

a process cartridge configured to be attached to the cartridge support member and detached from the cartridge support member and to have a plurality of first electrical contact points with predetermined lengths along a movement direction between the first and second positions;

a holder configured to be disposed in the main body, to be movable according to a length direction of the process cartridge, and to have a plurality of second electrical contact points electrically connectable to the plurality of first electrical contact points;

an interference protrusion configured to protrude to an inside of the main body, to be pushed in an outer direction of the main body by the cartridge support member while the cartridge support member moves between the second position and the third position, and to move the holder; and a groove configured provided in the cartridge support member so that the interference protrusion is inserted into the groove when the cartridge support member is at the second position, wherein the holder is configured such that the plurality of second electrical contact points are electrically connected to the plurality of first electrical contact points while the cartridge support member is at the first position, while the cartridge support member moves from the first position to the second position, and while the cartridge support member is at the second position, and the holder is further configured such that the plurality of second electrical contact points are electrically disconnected from the plurality of first electrical contact points while the cartridge support member departs from the second position and moves to the third position and while the cartridge support member is at the third position.

* * * * *